US009303448B2

(12) United States Patent
Olkin

(10) Patent No.: US 9,303,448 B2
(45) Date of Patent: Apr. 5, 2016

(54) FLOOD SHIELD SYSTEMS AND METHODS

(71) Applicant: Zachary Dax Olkin, Niwot, CO (US)

(72) Inventor: Zachary Dax Olkin, Niwot, CO (US)

( * ) Notice: Subject to any disclaimer, the term of this patent is extended or adjusted under 35 U.S.C. 154(b) by 0 days.

(21) Appl. No.: 14/520,810

(22) Filed: Oct. 22, 2014

(65) Prior Publication Data

US 2015/0107170 A1 Apr. 23, 2015

Related U.S. Application Data

(60) Provisional application No. 61/894,807, filed on Oct. 23, 2013.

(51) Int. Cl.

| | |
|---|---|
| ***E06B 9/13*** | (2006.01) |
| ***E06B 1/56*** | (2006.01) |
| *E06B 9/00* | (2006.01) |
| *E06B 9/58* | (2006.01) |

(52) U.S. Cl.

CPC ... *E06B 9/13* (2013.01); *E06B 1/56* (2013.01); *E06B 2009/007* (2013.01); *E06B 2009/588* (2013.01)

(58) Field of Classification Search

CPC ..... E04B 1/92; E06B 1/56; E06B 9/13; E06B 2009/007; E06B 2009/588

USPC ..... 52/202

See application file for complete search history.

(56) References Cited

U.S. PATENT DOCUMENTS

| | | | | | |
|---|---|---|---|---|---|
| 3,401,527 | A * | 9/1968 | Palmer | E02B 13/00 | 251/204 |
| 3,796,010 | A * | 3/1974 | Carlson | E06B 7/2318 | 405/106 |
| 4,073,147 | A * | 2/1978 | Nomura | 405/94 | |
| 4,349,296 | A * | 9/1982 | Langeman | 405/99 | |
| 4,377,352 | A * | 3/1983 | Goodstein | 405/115 | |
| 4,488,386 | A * | 12/1984 | Thompson | 52/169.1 | |
| 4,692,961 | A * | 9/1987 | Brown | 16/95 R | |
| 4,693,042 | A * | 9/1987 | Villarreal | 52/169.14 | |
| 4,754,696 | A * | 7/1988 | Sarazen et al. | 454/256 | |
| 5,077,945 | A * | 1/1992 | Koeniger | 52/169.14 | |
| 5,460,572 | A * | 10/1995 | Waltz et al. | 454/273 | |
| 5,487,701 | A * | 1/1996 | Schedegger et al. | 454/271 | |
| 5,645,373 | A * | 7/1997 | Jenkins | 405/91 | |
| 5,943,832 | A * | 8/1999 | Russell | 52/202 | |
| 5,944,445 | A * | 8/1999 | Montgomery | 405/92 | |
| 5,984,575 | A * | 11/1999 | Knott, Sr. | 405/92 | |
| 6,029,405 | A * | 2/2000 | Wood | 52/2.23 | |
| 6,287,050 | B1 * | 9/2001 | Montgomery et al. | 405/92 | |
| 6,327,819 | B1 * | 12/2001 | Kurose | 49/50 | |
| 6,393,782 | B1 * | 5/2002 | Berridge et al. | 52/239 | |
| 6,425,707 | B1 * | 7/2002 | Baxter | 405/87 | |

(Continued)

*Primary Examiner* — James Ference

(74) *Attorney, Agent, or Firm* — Lathrop & Gage LLP

(57) ABSTRACT

A deployable flood shield, and associated method, prevents ingress of water through an opening. An outer frame is positioned to surround the opening and has a top channel, a bottom channel, a left channel and a right channel. A flexible shield is stored within the bottom channel prior to deployment and has a left edge retained by the left channel and a right edge retained by the right channel. Seals are configured with each of the bottom, left, and right channels for sealing between the bottom, left, and right channels and the flexible shield when deployed. A controller deploys the flexible shield to prevent the ingress of water into the opening. A deploy command is received and a motor is driven, for a predefined period, to deploy a flexible shield to block the opening and preventing the flexible shield from retracting.

19 Claims, 11 Drawing Sheets

(56) References Cited

U.S. PATENT DOCUMENTS 6,427,396 B1 * 8/2002 Harrison ..... 52/202
6,427,718 B1 * 8/2002 Stringam ..... A01G 25/16 137/392
6,485,231 B2 * 11/2002 Montgomery et al. ..... 405/92
6,588,979 B1 * 7/2003 Pasij ..... 405/114
6,623,209 B1 * 9/2003 Waters, Jr. ..... 405/94
6,691,761 B1 * 2/2004 Alkhoury ..... E06B 9/54 160/273.1
6,692,187 B2 * 2/2004 Sprengle et al. ..... 405/92
6,737,968 B1 * 5/2004 Ergun ..... G07C 9/00182 340/12.54
6,884,002 B1 * 4/2005 Fuller ..... 405/114
6,931,802 B2 * 8/2005 Jones et al. ..... 52/202
6,991,403 B1 * 1/2006 Hendee ..... 405/114
7,261,492 B2 * 8/2007 Hendee ..... 405/115
7,497,644 B1 * 3/2009 Cohen ..... 405/96
7,523,589 B1 * 4/2009 Smith ..... 52/202
7,546,710 B2 * 6/2009 Abbott ..... 52/202
7,549,252 B2 * 6/2009 Vaughn ..... 49/466
7,552,565 B1 * 6/2009 Smith ..... 52/202
7,600,944 B1 * 10/2009 Keating ..... 405/96
7,926,539 B1 * 4/2011 Hurst et al. ..... 160/104
7,951,291 B2 * 5/2011 Nino ..... 210/131
7,972,081 B2 * 7/2011 Linares ..... 405/105
8,246,272 B1 * 8/2012 Heitz ..... 405/92
8,277,645 B2 * 10/2012 Jarvis et al. ..... 210/131
8,308,396 B2 * 11/2012 Shook ..... 405/100
8,375,664 B2 * 2/2013 Gower et al. ..... 52/302.1
8,613,171 B2 * 12/2013 Dudash ..... 52/213
2001/0015038 A1 * 8/2001 Cadalso ..... 52/202
2001/0015266 A1 * 8/2001 Yates ..... E06B 9/0692 160/84.06
2002/0080038 A1 * 6/2002 Smith ..... 340/601
2003/0026658 A1 * 2/2003 Wu ..... E02B 7/30 405/87
2003/0082007 A1 * 5/2003 Liou ..... 405/87
2003/0110717 A1 * 6/2003 Rodriguez ..... 52/202
2003/0167696 A1 * 9/2003 Chen ..... 49/477.1
2004/0194426 A1 * 10/2004 Shapero ..... 52/749.1
2004/0200169 A1 * 10/2004 Hung ..... 52/455
2004/0267385 A1 * 12/2004 Lingemann ..... 700/83
2005/0081447 A1 * 4/2005 Kline ..... E06B 7/28 49/209
2005/0129463 A1 * 6/2005 Craig ..... E02B 13/02 405/99
2005/0163570 A1 * 7/2005 Cullen ..... 405/87
2005/0210777 A1 * 9/2005 Baughn et al. ..... 52/202
2008/0098679 A1 * 5/2008 Chan ..... 52/302.1
2009/0025317 A1 * 1/2009 Wirz et al. ..... 52/202
2009/0252557 A1 * 10/2009 Fisher ..... 405/107
2010/0006239 A1 * 1/2010 Kraeutler ..... E06B 9/58 160/272
2010/0032105 A1 * 2/2010 Drifka ..... E06B 9/13 160/8
2010/0043298 A1 * 2/2010 Anhamm ..... 49/383
2010/0306533 A1 * 12/2010 Phatak ..... 713/156
2011/0108214 A1 * 5/2011 Komatsu ..... E06B 9/13 160/272
2011/0154752 A1 * 6/2011 Grover et al. ..... 52/202
2011/0283620 A1 * 11/2011 Drifka ..... E06B 9/17046 49/70
2011/0284249 A1 * 11/2011 Wong ..... A62C 2/10 169/48
2011/0296774 A1 * 12/2011 Tremaine, III ..... E06B 9/0692 52/202
2012/0005960 A1 * 1/2012 Tseng ..... 49/31
2012/0137584 A1 * 6/2012 Thomas ..... 49/13
2013/0061522 A1 * 3/2013 Alexander et al. ..... 49/11
2013/0094906 A1 * 4/2013 Rijlaarsdam ..... 405/115
2013/0199516 A1 * 8/2013 Snyder ..... F24J 2/04 126/633
2013/0272794 A1 * 10/2013 Osborne ..... 405/110
2013/0340340 A1 * 12/2013 Fukagawa ..... 49/10
2014/0110066 A1 * 4/2014 Rijlaarsdam ..... 160/130

* cited by examiner

CROSS-SECTION B-B OF FIG. 1

FLOOD SHIELD SYSTEMS AND METHODS

RELATED APPLICATIONS

This application claims priority to U.S. Patent Application Ser. No. 61/894,807, titled "Flood Shield Systems and Methods", filed Oct. 23, 2013, and is incorporated herein by reference.

BACKGROUND

Basements of properties located in a potential area of flooding are particularly vulnerable to flooding through basement windows. Although prevention is sometimes possible if the property owner/manager can divert the flow of water (e.g., using sand bags), often the owner/manager is unable to mitigate the damage, especially in the event of a flash flood.

During a flood, major damage is caused by water and debris getting into a building. This can be caused by the breaking of basement windows due to the force of the floodwater, or the force of an object being carried by water hitting the window. Once the window breaks, water and mud are free to flow into the basement, causing massive damage. Many people do not have or cannot afford flood insurance to cover damage.

In most cases, any kind of shutter is normally manually deployed or installed at the time it is needed. But flash flood warnings do not leave enough time for manual intervention. Indeed, the homeowners may not even be home to perform the task.

SUMMARY OF THE INVENTION

Our solution to this common problem is a deployable waterproof shield that protects a building from flooding during a flood. The flood shield consists of a casing (sometimes referred to as a box or frame hereinafter) that is attached to an exterior wall surrounding an opening (e.g., a window or a door) in the building. The flood shield may be attached to the building after its construction, or may be configured with the building during construction. The shield is in one of two states: deployed or non-deployed. The shield starts in the non-deployed state. In the non-deployed state, the window is unobstructed so that it can be opened fully, allowing both air and light to pass freely and to allow egress. Since the box is outside of the window casing, the view out the window is entirely unobstructed.

In the event of a flood, the shield is deployed. There are a number of ways the shield can be activated, which are discussed later. The activation of the shield causes a waterproof, impenetrable material to cover the entire opening of the casing and prevents any water from getting through or past the shield. The material itself, described later in more detail, is flexible so that it can be stored in a rolled up state when not deployed, but is impenetrable to both water and hard objects that might come in contact with it. Once deployed, the window is protected from both floodwaters and from debris being carried by the water. When the event is over, the shield can be re-stowed so that it can be ready for use at a future time.

In one embodiment, a deployable flood shield prevents ingress of water through an opening. An outer frame is positioned to surround the opening and has a top channel, a bottom channel, a left channel and a right channel. A flexible shield is stored within the bottom channel prior to deployment and has a left edge retained by the left channel and a right edge retained by the right channel. Seals are configured with each of the bottom, left, and right channels for sealing between the bottom, left, and right channels and the flexible shield when deployed. A controller deploys the flexible shield to prevent the ingress of water into the opening.

In another embodiment, a method prevents ingress of water through an opening, and includes the steps of receiving a deploy command, driving, for a predefined period, a motor to deploy a flexible shield to block the opening, and preventing the flexible shield from retracting. The deployed flexible shield is held in position by a frame around the opening.

DETAILED DESCRIPTION OF THE EMBODIMENTS

Figure 1:
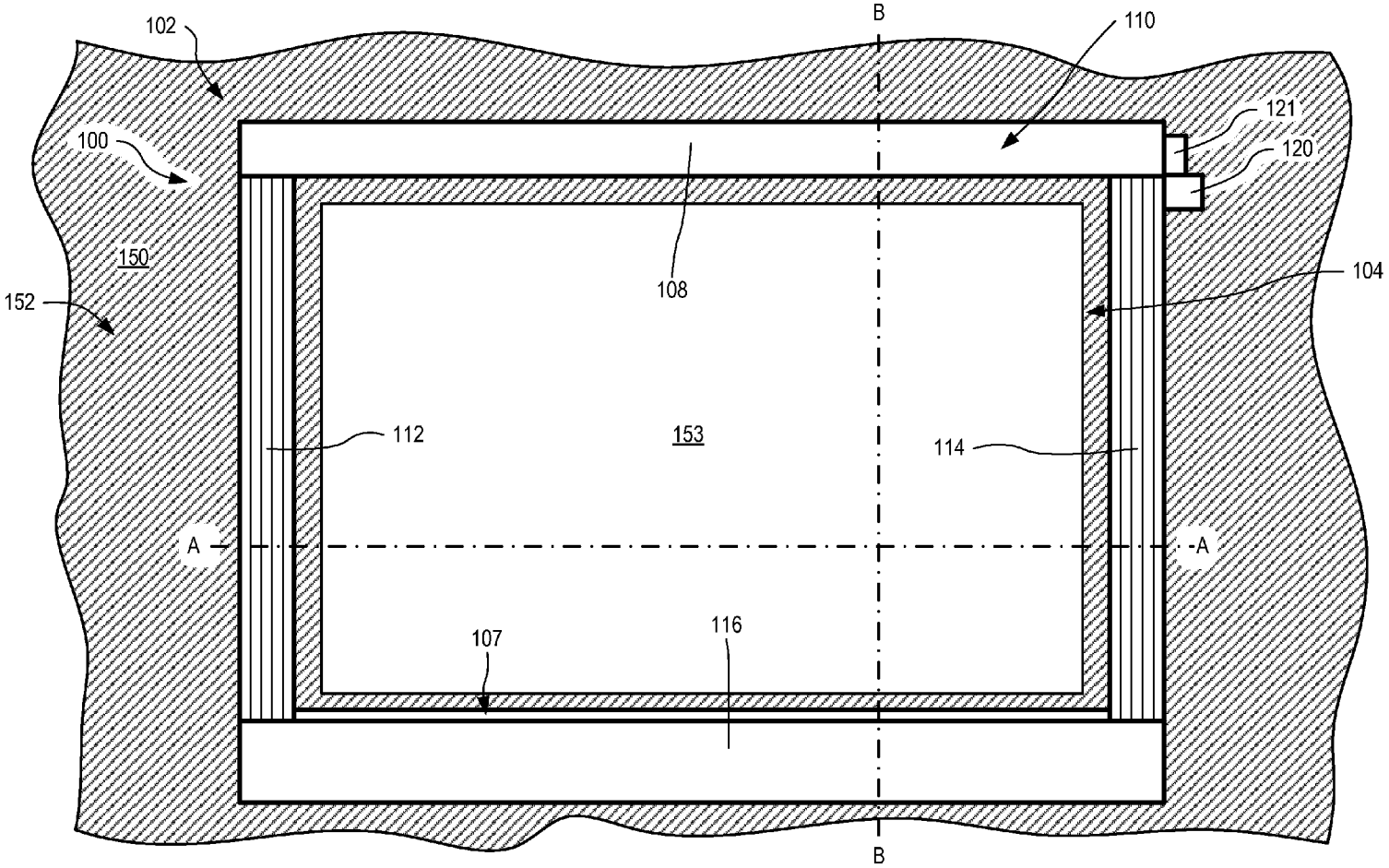
FIG. 1 is a front view of one exemplary flood shield positioned on an exterior surface of a building prior to deployment, in an embodiment.

FIG. 1 is a front view of one exemplary flood shield 100 positioned on an exterior surface 152 of a building 150 prior to deployment. Flood shield 100 is deployed to prevent flooding through an opening 153 (e.g., one or more of a window, a doorway, and other such openings within a wall or structure) of the building. Flood shield 100 has a top channel 108, a left channel 112, a right channel 114, and a bottom channel 116 that cooperate to form an exterior frame (casing/box) 102 that is positioned on exterior surface 152 to surround opening 153. For example, flood shield 100 may be positioned within a window well of the building such that frame 102 surrounds a basement window. Flood shield 100 may be added to an existing building or may be configured with the building during construction of the building.

Figure 2:
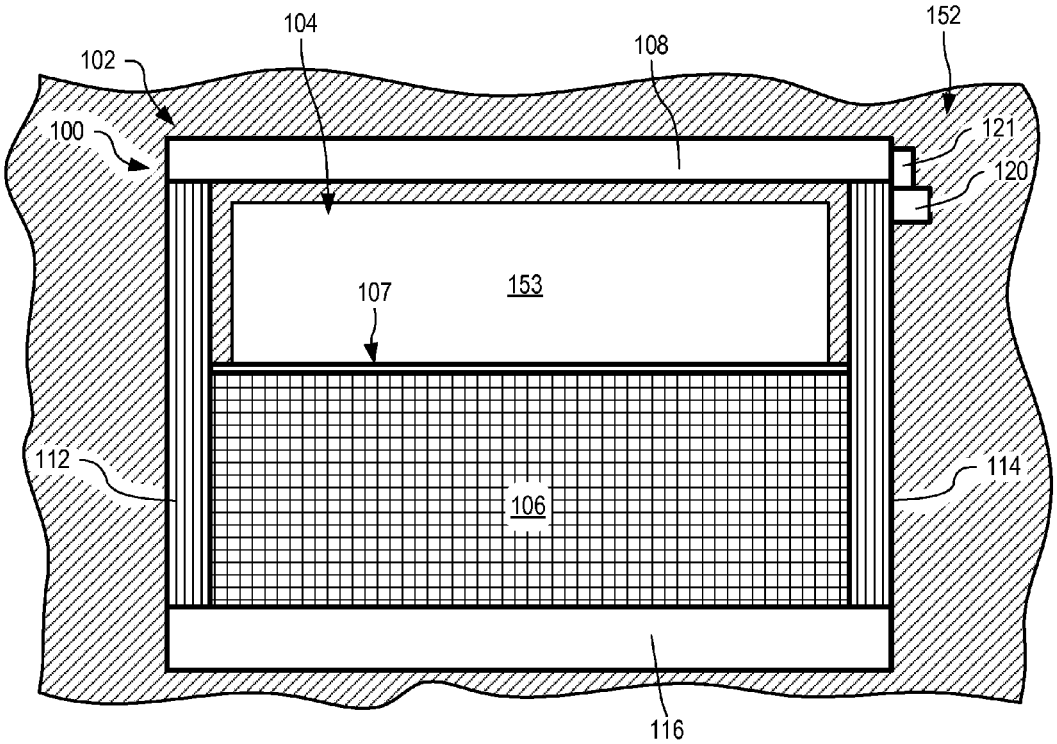
FIG. 2 shows the flood shield of FIG. 1 with the flexible shield partially deployed.
Figure 3:
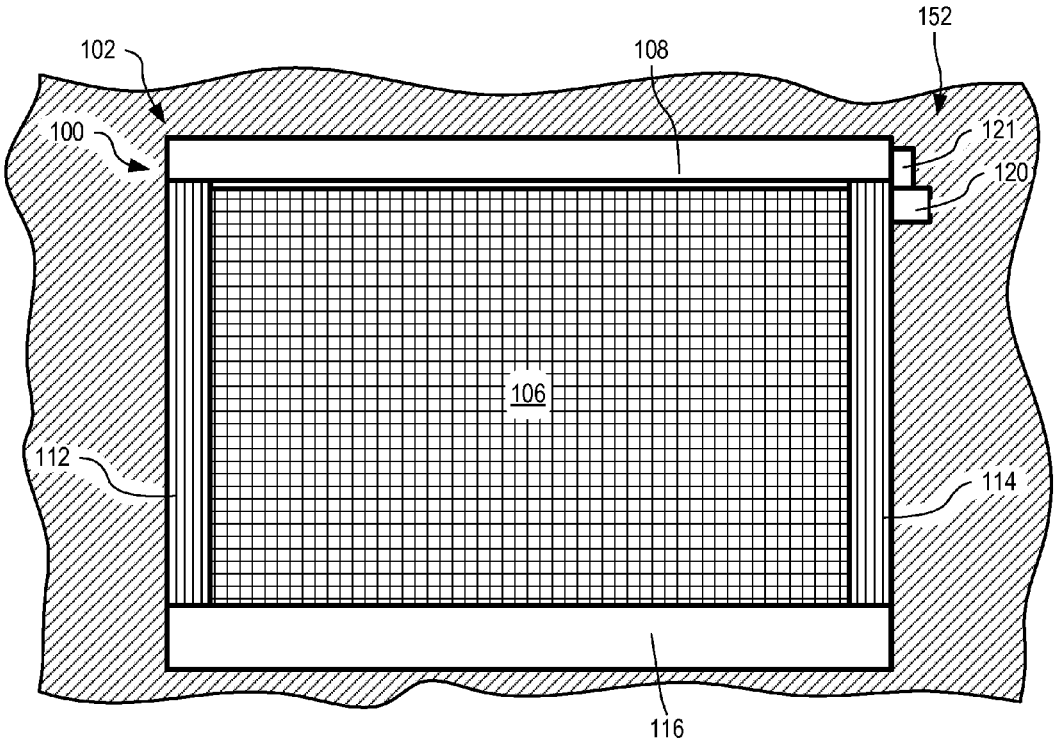
FIG. 3 shows the flood shield of FIG. 1 with the flexible shield fully deployed.

FIG. 2 shows flood shield 100 of FIG. 1 with a flexible shield 106 partially deployed. FIG. 3 shows flood shield 100 of FIG. 1 with flexible shield 106 fully deployed. FIGS. 1-3 are best viewed together with the following description.

As shown in FIG. 3, frame 102 has an opening 104 that is filled by a flexible shield 106 when flood shield 100 is deployed. When flood shield 100 is not deployed, as shown in FIG. 1, flexible shield 106 is rolled up and stored within bottom channel 116 of frame 102 such that opening 104 is not filled, thereby allowing the surrounded opening 153 (e.g., window) to be used as normal. Flexible shield 106 is constructed as a flexible material that is waterproof, has a high tensile strength, and is resistant to penetration and tearing. In one embodiment, shield 106 is formed from a first strong but non-water resistant material that is laminated with a second water-proof material. For example, flexible shield 106 may be formed of a heavy-duty canvas (e.g., a rhino canvas or similar material) that is laminated with a second flexible waterproofing material such as vinyl. In another embodiment, where additional strength is desired, shield 106 is formed from a laminated Kevlar material.

Shield 106 is flexible and easily rolled-up for compact storage within bottom channel 116. Shield 106 is also significantly cheaper to manufacture, as compared to standard metal shutters that may be used to secure windows and doors during inclement weather.

Top channel 108 may include a compartment 110 for storing control electronics (see controller 1100 of FIG. 11) and a battery that provides power to deploy flood shield 100. Although illustrated as being stored within bottom channel 116, it will be appreciated that shield 106 may be stored within top channel 108 and pulled down for deployment without departing from the scope hereof. Similarly, the battery may be located anywhere within frame 102 or positioned external to frame 102 without departing from the scope hereof.

Flood shield 100 also includes a motor 120 and drive gear 121 for deploying flood shield 100. Although shown external to frame 102, motor 120 and drive gear 121 may be positioned within frame 102 without departing from the scope hereof. For example, motor 120 and drive gear 121 may be configured within top channel 108. Drive gear 121 is configured such that shield cannot retract once deployed. For example, drive gear 121 may include a ratchet mechanism that prevents flexible shield 106 from retracting once deployed.

Figure 4:
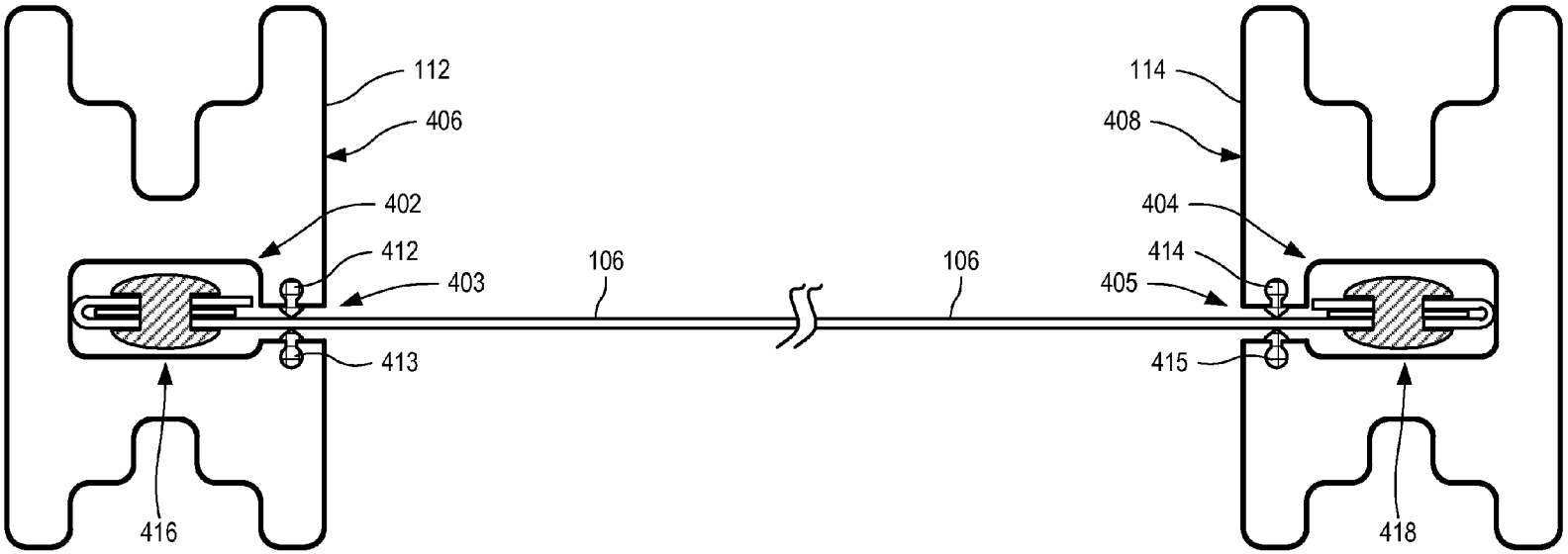
FIG. 4 shows a cross section A-A through the flood shield of FIG. 1.

FIG. 4 shows a cross section A-A through flood shield 100 of FIG. 1. Left channel 112 contains a left passage 402 and left slot 403 that both run vertically through left channel 112. Slot 403 forms an opening to left passage 402 on an inside edge 406 of left channel 112. Similarly, right channel 114 contains a right passage 404 and a right slot 405 that both run vertically through right channel 114. Slot 405 forms an opening to right passage 404 on an inside edge 408 of right channel 114.

A left edge 416 of flexible shield 106 is positioned within, and retained by, left passage 402 such that flexible shield 106 passes through left slot 403. Left slot 403 has seals 412, 413 positioned on either side of slot 403 and running the entire length of slot 403. A right edge 418 of flexible shield 106 is positioned within, and retained by, right passage 404 such that flexible shield 106 passes through right slot 405. Right slot 405 has seals 414, 415 positioned on either side of slot 405 and running the entire length of slot 405. Seals 412, 413 and seals 414, 415 form a substantially watertight seal with shield 106 when deployed and allow shield 106 to pass therebetween during deployment.

Figure 5:
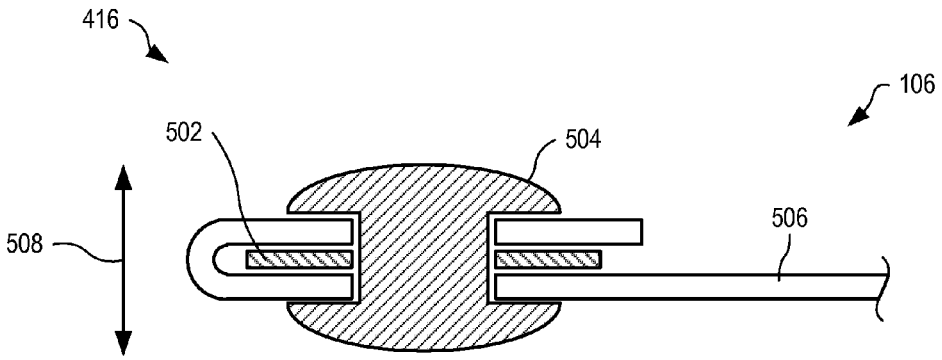
FIG. 5 shows a left edge of the flexible shield of FIG. 4 in further exemplary detail.
Figure 6:
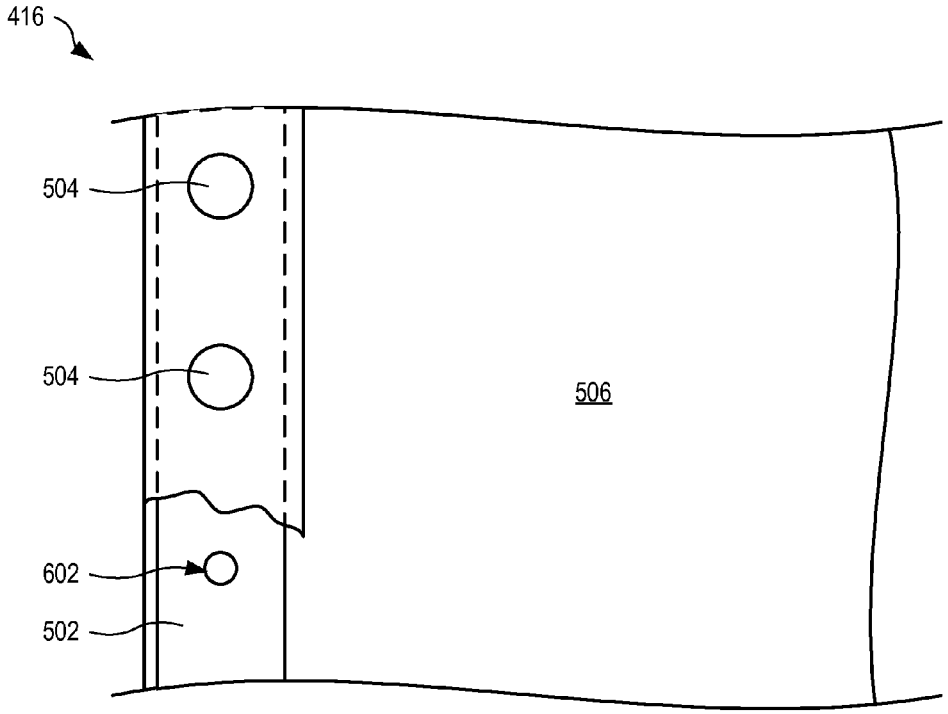
FIG. 6 shows a rear cut-away view of the left edge of the flexible shield of FIG. 4.

FIG. 5 shows left edge 416 of flexible shield 106 in further exemplary detail. FIG. 6 shows a rear cut-away view of left edge 416. FIGS. 5 and 6 are best viewed together with the following description. Right edge 408 is a lateral reversal of left edge 416. The edge of material 506 of flexible shield 106 is wrapped around a thin spring strip 502 (e.g., a spring steel or plastic material) and are secured together by a plurality of rivets 504. Spring strip 502 may have pre-formed holes 602 to facilitate application of rivets 504. Other methods of coupling material 506 to spring strip 502 may be used without departing from the scope hereof.

As shown in FIG. 4, rivets 504 and spring strip 502 increase the thickness 508 of edge 416, and similarly edge 418, to be greater than the width of slots 403, 405, such that edges 416, 418 are retained within passages 402, 404, respectively.

Figure 7:
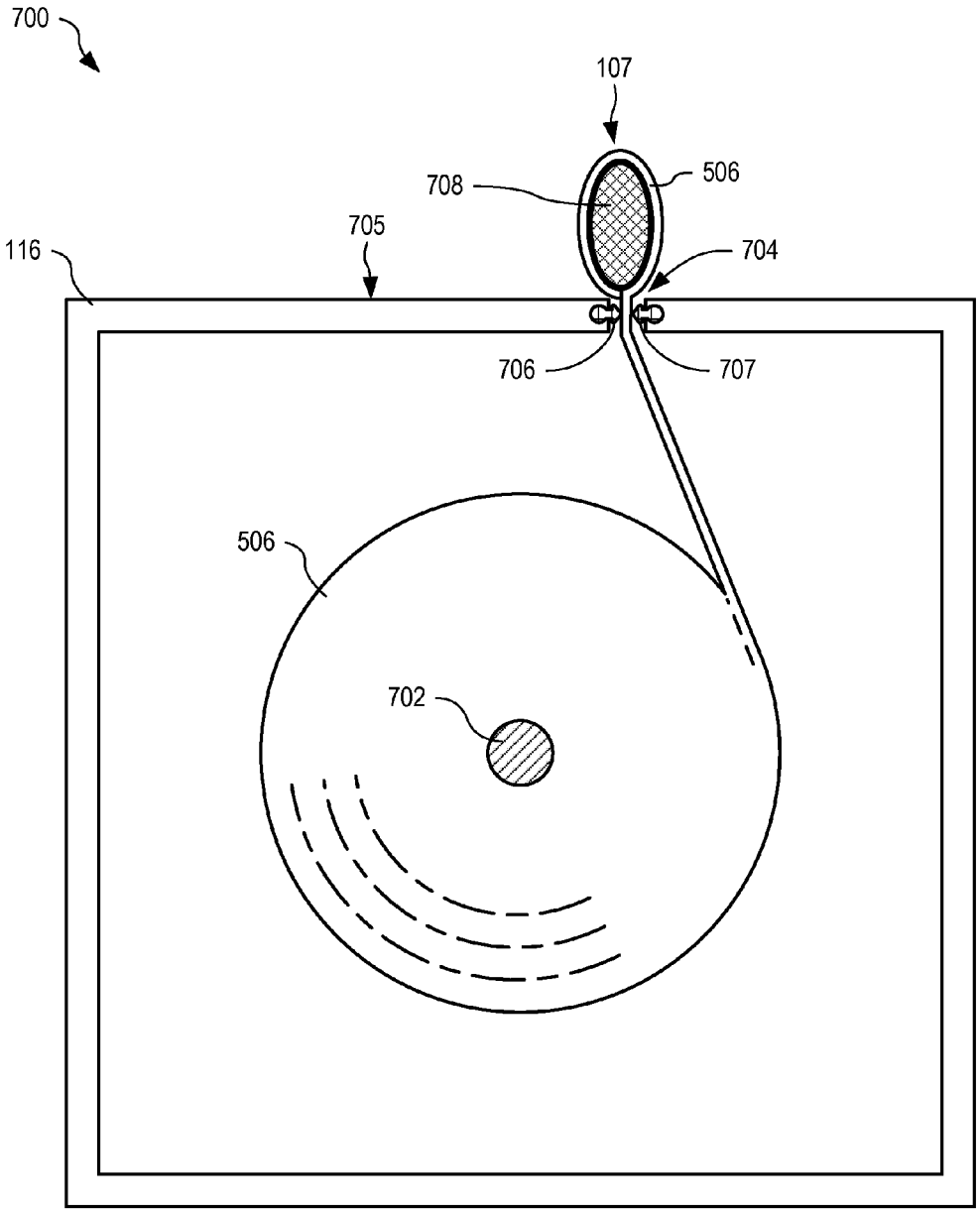
FIG. 7 shows a cross sectional view through the bottom channel, at line B-B, of the flood shield of FIG. 1 when not deployed.

FIG. 7 shows a cross sectional view 700 through bottom channel 116 at line B-B of flood shield 100 of FIG. 1 when not deployed. Material 506 of shield 106, including left and right edges 406, 408, is wound around a roller 702 positioned lengthwise within bottom channel 116 of frame 102. Bottom channel 116 has a top slot 704 formed on a top side 705 of bottom channel 116. Slot 704 has first and second seals 706, 707, respectively, that allow material 506 to pass through during deployment while forming a substantially watertight seal with flexible shield 106 when deployed. Material 506 is permanently attached to roller 702 and is thereby retained within bottom channel 116 when shield 106 is deployed. Roller 702 is for example constructed of metal or other bend resistant material. Seals 412, 413, 414, 415, 706, and 707 are formed of a pliable material (e.g., rubber, soft plastic).

A top edge 107 of flexible shield 106 is strengthened by a bar 708 that extends between left channel 112 and right channel 114. Material 506 is permanently attached to bar 708. In one embodiment, material 506 is wrapped around bar 708 and stitched such that bar 708 is retained within top edge 107 of shield 106. In an alternate embodiment, bar 708 is an inverted "U" shape and compressed onto a top edge of material 506 to form top edge 107.

Figure 8:
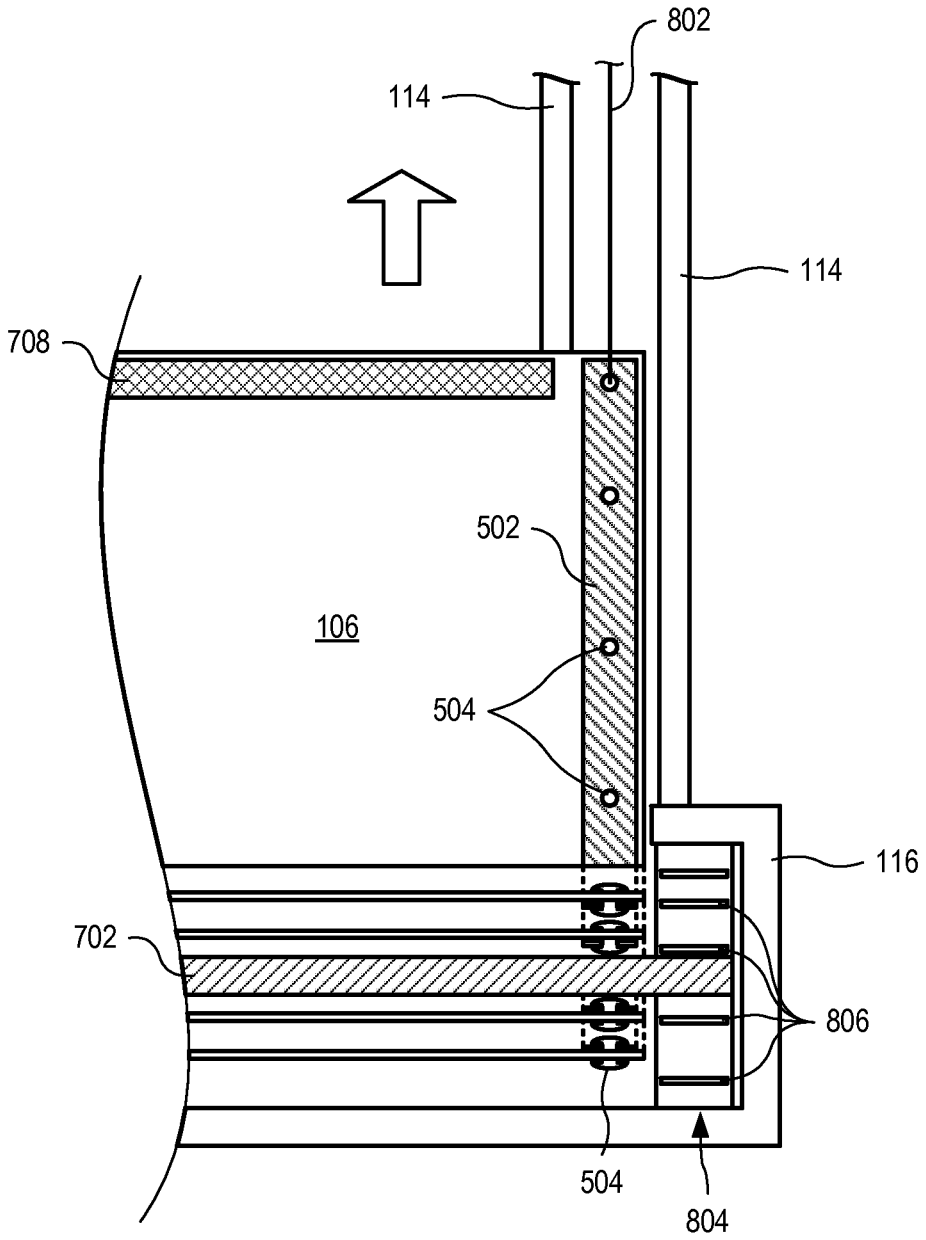
FIG. 8 shows a cut-away view of a right-hand end of the bottom channel of the flood shield of FIG. 1 illustrating an automatic retracting mechanism.
Figure 9:
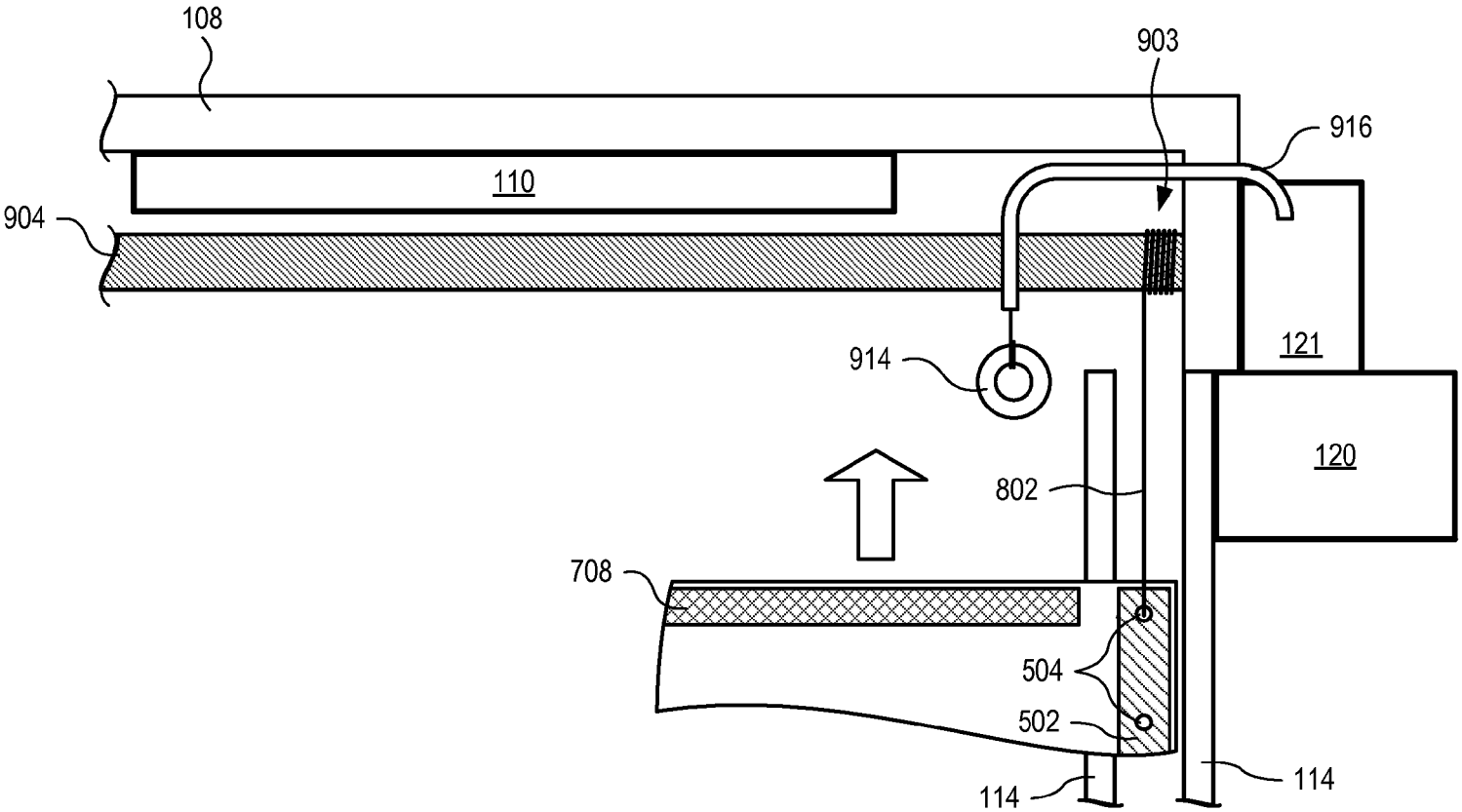
FIG. 9 shows a cut-away view of a right-hand end of the top channel of the flood shield of FIG. 1 illustrating a pull cable for deploying the flood shield.

FIG. 8 shows a cut-away view of a right-hand end of bottom channel 116 of flood shield 100 of FIG. 1, illustrating an automatic retracting mechanism 804. FIG. 9 shows a cut-away view of a right-hand end of top channel 108 illustrating a pull cable 802 (e.g., made of a high tensile material such as steel) attached to a right hand top corner of flexible shield 106 and attached to a rod 904 at a winding area 903. FIGS. 8 and 9 are best viewed together with the following description.

Rod 904 is rotated, during deployment of flood shield 100, by a motor 120 via drive gear 121. As rod 904 rotates, cable 802 is wound around rod 904 at winding area 903. A similar cable and wind up area are positioned in the upper left portion of flood shield 100. Thus, as rod 904 is rotated by motor 120, shield 106 is pulled off of, and up from, roller 702 within bottom channel 116. As shield is pulled up, left and right edges 416, 418 of shield 106 slide upwards within passages 402, 404, respectively, until top edge 107 of shield 106 reaches top channel 108.

Bottom channel 116 includes a retracting mechanism 804 that has a spring 806 coupled with roller 702 and bottom channel 116. As shield 106 is deployed and roller 702 rotates, spring 806 is wound up. Retracting mechanism 804 thereby applies a tension to shield 106 during deployment. A pull 914 is provided to allow a user to retract flexible shield 106, as may be required for emergency egress through opening 153. In one embodiment, pull 914 is coupled via a channel 916 to drive gear 121 and operates to disengage the ratchet mechanism such that retracting mechanism 804 automatically retracts flexible shield 106. Pull 914 is for example positioned on an inside surface of flood shield 100 that is accessible from opening 153 when flood shield 100 is deployed. In one embodiment, pull 914 is positioned on an inner reachable surface (e.g., a lower end of right channel 114, or an inward facing surface of bottom channel 116) of flood shield 100. Releasing pull 914 causes ratchet mechanism within drive gear 121 to reengage, allowing for normal operation of flood shield 100.

Figure 9A:
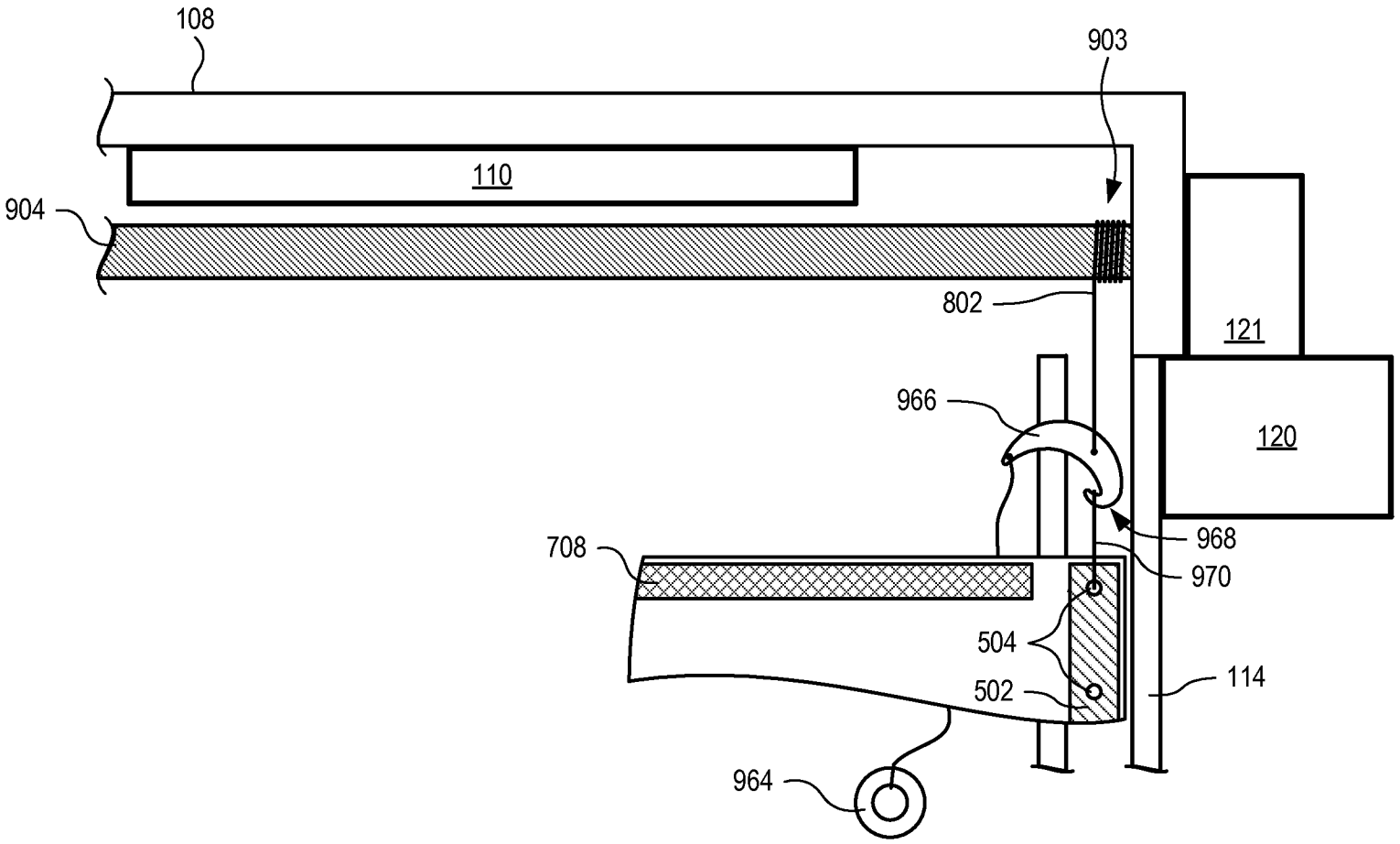
FIG. 9A shows a cut-away view of a right-hand end of the top channel of the flood shield illustrating an alternative mechanism for allowing a user to retract the flexible shield, in an embodiment.

FIG. 9A shows a cut-away view of a right-hand end of top channel 108 illustrating an alternative embodiment for allowing a user to retract flexible shield 106. FIG. 9A is similar to FIG. 9, but pull 914 is replaced by a pull 964 and a decoupling mechanism 966 that, when activated by pull 964, decouples cable 802 from flexible shield 106. For example, as pull 964 is pulled down, decoupling mechanism 966 pivots and hook 968 disengages from a connecting loop 970. Connecting loop 970 is attached to a top corner of flexible shield 106 as shown. A similar mechanism is provided for left channel 112. When both left and right pulls 964 are pulled downward, flexible shield 106 is released from cables 802 and retracting mechanism 804 automatically retracts flexible shield 106.

Figure 10:
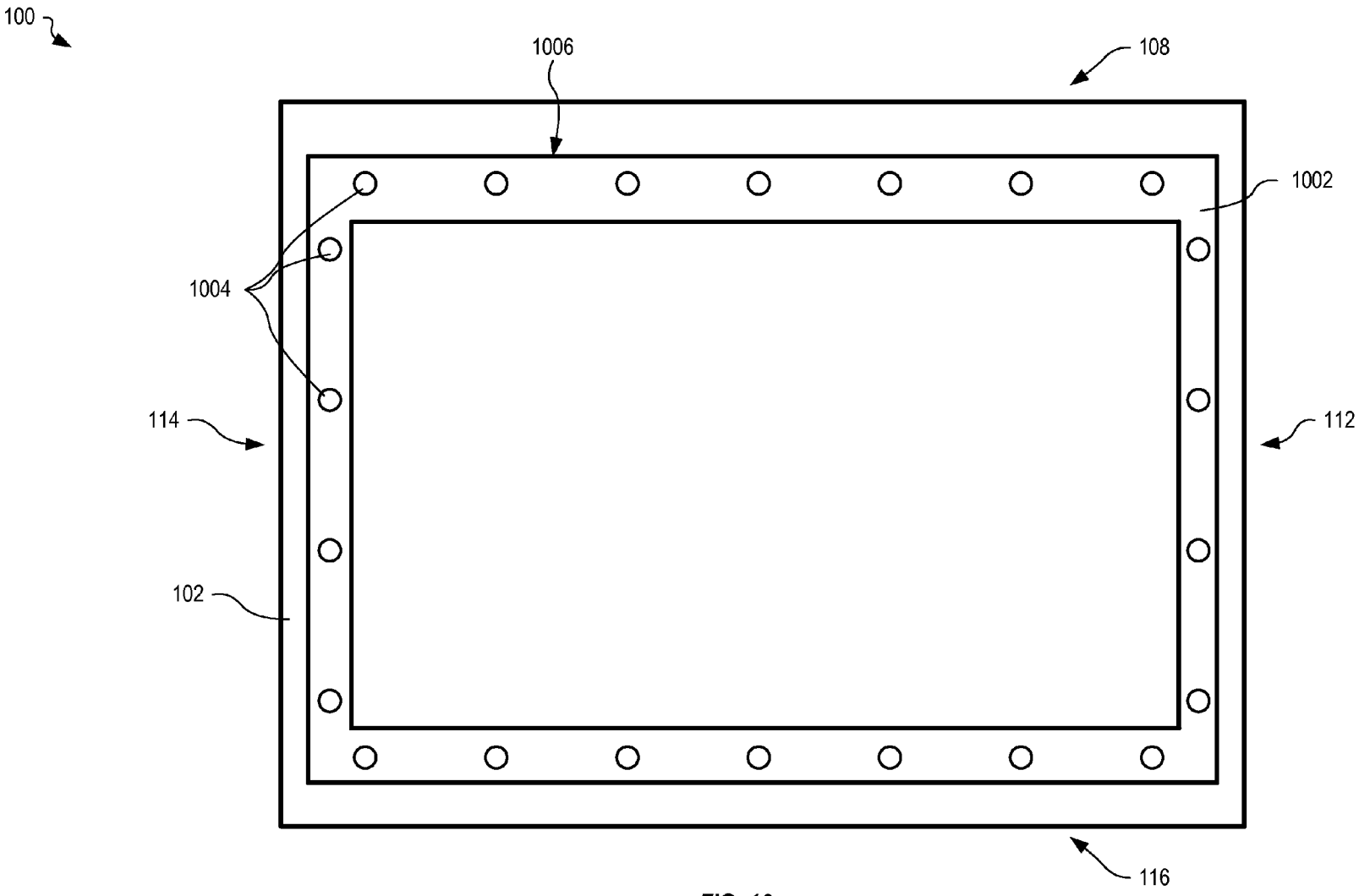
FIG. 10 is a rear view of the flood shield of FIG. 1, illustrating exemplary mounting holes formed within a mounting bracket for attaching the flood shield to a building, in an embodiment.

FIG. 10 is a rear view of flood shield 100 of FIG. 1, illustrating exemplary mounting holes 1004 formed within a mounting bracket 1002 for attaching flood shield 100 to a building. A rubber seal 1006 prevents water ingress between mounting bracket 1002 and frame 102 when flood shield 100 is mounted to a wall of the building. A sealing compound and/or rubber stripping may be applied between mounting bracket 1002 and the wall of the building to ensure water is kept out. A watertight seal is thus created when frame 102 is tightly mounted to exterior surface 152.

Figure 11:
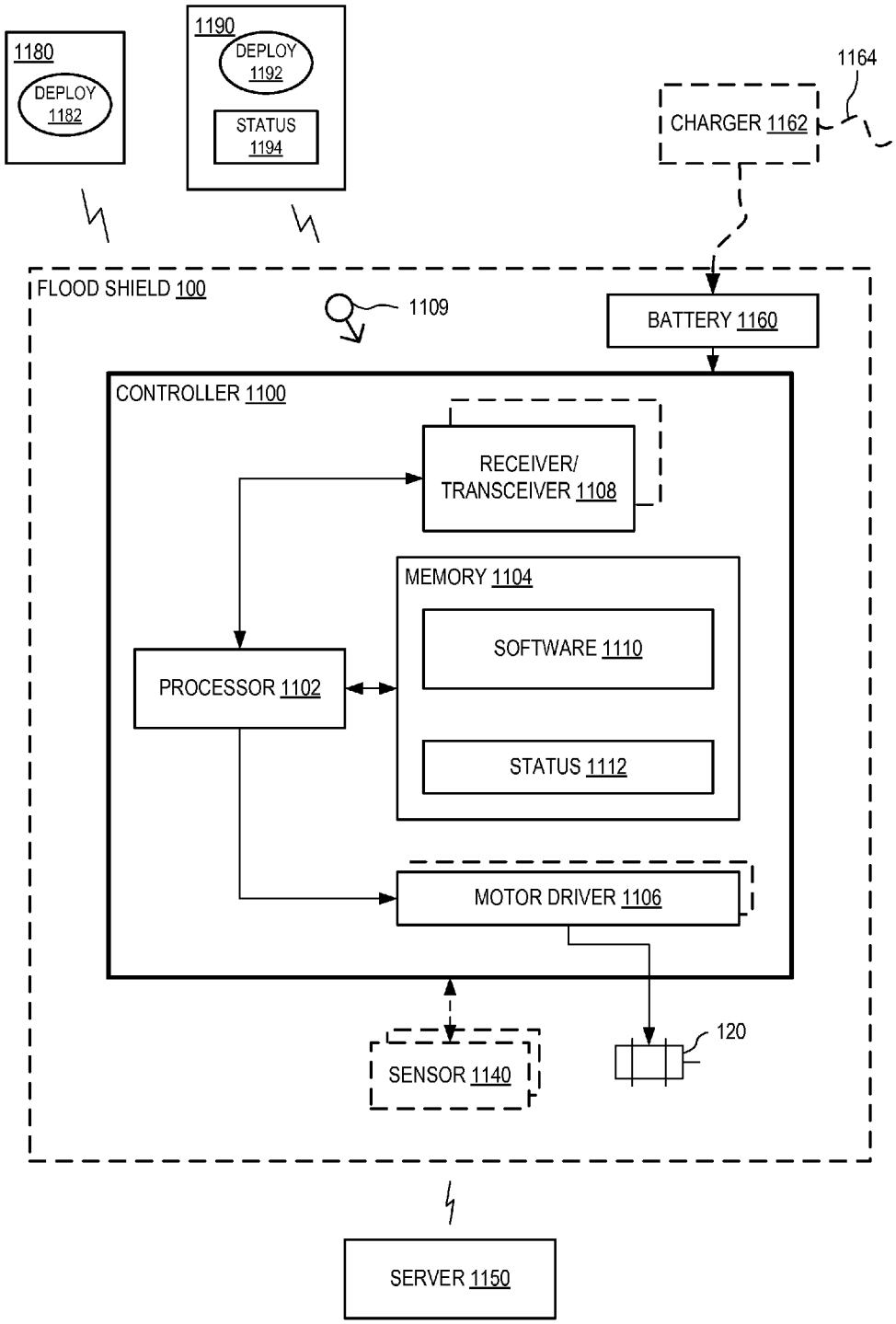
FIG. 11 shows one exemplary controller for deploying the flood shield of FIG. 1, in an embodiment.

FIG. 11 shows one exemplary controller 1100 for deploying flood shield 100 of FIG. 1. Controller 1100 includes a processor 1102, a memory 1104, at least one motor driver 1106, and at least one receiver/transceiver 1108. A battery 1160 powers controller 1100 and thereby other components of flood shield 100, such as motor 120. Receiver/transceiver 1108 may represent one or more of a wireless network transceiver, a cellular transceiver, and a radio-frequency receiver. Receiver/transceiver 1108 may communicate with a wireless local area network (e.g., Wi-Fi) and/or a cellular network as used by mobile phones, to receive instructions from one or more radio transmitters, such as a remote control device 1180. Battery 1160 may be continually trickle charged by a charger 1162 that connects to an electrical power source 1164 (e.g., 110V AC power). Charger 1162 may additionally include solar components such that battery 1160 is also, or alternatively, charged by solar energy. Battery 1160 enables operation of flood shield 100 when for example inclement weather renders power via a local power grid unavailable. In another embodiment, battery 1160 and charger 1162 are not included and controller 1100 is powered directly via electrical power source 1164. In another embodiment, battery 1160 is not rechargeable (i.e., a single use battery).

Memory 1104 is shown storing software 1110 that has machine-readable instructions that when loaded and executed by processor 1102 perform functionality of controller 1100 as described herein. Memory is also shown storing a status 1112 that represents a current status of flood shield 100 determined by controller 1100. For example, software 1110 may monitor voltage of battery 1160 and store an indicator (e.g., good/bad or the measured voltage, etc.) thereof within status 1112. Optionally, flood shield 100 includes one or more sensors 1140 coupled with controller 1100. For example, sensor 1140 may sense a deployment status of flood shield 100, to indicate whether shield 106 is fully deployed. In another embodiment, one or more sensors 1140 are positioned within flood shield 100 to sense environmental conditions, such as pressure (internal and external to shield 106), temperature (internal and external to shield 106), and so on. Flood shield 100 may include and report information from other sensors without departing from the scope hereof.

In one embodiment, controller 1100 includes multiple receivers/transceivers 1108 such that any one of a wireless local area network (e.g., Wi-Fi), a cellular network as used by mobile phones, and a radio transmitter may be used to communicate with flood shield 100. Flood shield 100 may thus be monitored and controlled by any of these communication means.

Controller 1100 may receive, within receiver/transceiver 1108, a deploy command 1109 from one or more of remote control device 1180, mobile device 1190, remote server 1150 via Internet, and a radio transmitter (e.g., an emergency signal). In one example of operation, a user presses deploy button 1182 of remote 1180 to transmit a wireless signal indicating the required deployment to receiver/transceiver 1108. In another example of operation, receiver/transceiver 1108 detects a broadcast emergency signal and initiates deployment automatically. In another example of operation, an owner of a property uses mobile device 1190 (e.g., a smart phone) to automatically send deploy command 1109 to flood shield 100, via receiver/transceiver 1108 and a Wi-Fi network or a cellular network. In another example of operation, deploy command 1109 may originate from a remote service center and is received by receiver/transceiver 1108 of flood shield 100 via Wi-Fi and/or cellular networks. Optionally, software 1110 may authenticate deploy command 1109 to ensure the source of the command is a source authorized to deploy flood shield 100. In one embodiment, deploy command 1109 includes at least one security feature that is identified and/or checked by software 1110 as an indication of authenticity of deploy command 1109 and its source.

Wireless Network Connectivity

For example, if a property is equipped with a wireless local area network, Wi-Fi, flood shield 100 may be configured to communicate via that network. Flood shield 100 may be added to the network in a similar manner to other devices (e.g., computers, TiVo, Nest, TVs, BluRay devices, etc.). Once connected to the network, flood shield 100 may also connect to the Internet, thereby allowing remote monitoring and control of flood shield 100. With appropriate authorization, status 1112 of flood shield 100 may be remotely monitored and controlled from anywhere with Internet connectivity. For example, status and control of flood shield 100 may be available using a web browser and/or an app (running on a smart device).

Cellular Network Connectivity

Not all homes are equipped with a wireless local area network (Wi-Fi). Therefore, receiver/transceiver 1108 may be configured to communicate using a cellular network instead of, or as well as, Wi-Fi. For example, the cellular network may provide communication with the Internet in the absence of Wi-Fi.

In one embodiment, receiver/transceiver 1108 is configured to receive an emergency broadcast signal via a cellular network. During severe weather, upon receiving the emergency broadcast signal, controller 1100 may be configured to automatically deploy flood shield 100. Thus, commands from an owner, or a service center, are not needed to protect the property.

Radio Frequency (RF) Receiver

Whether or not one or both of Wi-Fi and cellular networks are available, receiver/transceiver 1108 is configured to receive RF signals, for example as generated by nearby remote control device 1180. Remote control device 1180 is similar to a garage door opener, for example, and includes a deploy button 1182, that upon activation, transmits an RF signal to receiver/transceiver 1108. Remote 1180 allows a homeowner to deploy flood shield 100 by pressing deploy button 1182 while remote 1180 is in range of flood shield 100. Remote 1180 may be configured (e.g., paired) to control one or more specific flood shields 100. For example, one remote control device 1180 may be paired with multiple flood shields 100 such that all are deployed simultaneously upon activation of deploy button 1182.

Upon receiving a "deploy" command via receiver/transceiver 1108, processor 1102 executes software 1110 to control motor driver 1106 to drive motor 120 to deploy flood shield 100.

Controller 1100 may also receive a status request, via receiver/transceiver 1108, and respond by sending, via receiver/transceiver 1108, information of status 1112 in reply. That is, mobile device 1190 may request a status from controller 1100, receiving and displaying status 1194 in response. Thus, the user of mobile device 1190 may view a current status of flood shield 100 and remotely deploy flood shield 100.

A server 1150 may communicate with controller 1100 to receive status 1112 and to automatically deploy flood shield 100. Server 1150 may be run by a service company that monitors status 1112 of flood shield 100 and deploys flood shield 100 when needed, for example as determined from emergency information relevant to the installed location of flood shield 100. By monitoring status 1112 of flood shield 100, servicing of flood shield 100 may be scheduled as needed. In one operational example, server 1150 monitors a plurality of flood shields 100 that are deployed on buildings within an area susceptible to flooding. When server 1150 learns (e.g., from a government agency) of possible flooding in that area, server 1150 sends "deploy" commands to the plurality of flood shields 100 and verifies successful deployment through monitoring of status 1112.

In one embodiment, controller 1100 periodically sends status information to one or both of server 1150 and mobile device 1190.

Once deployed, flood shield 100 is able to hold the pressure and force of a flood as well as the force of blunt objects and debris that could be hurdled at it. The design ensures that water cannot seep past the edges. When properly installed, flood shield 100 prevents water and debris from entering a basement via the windows/doorways/openings it is protecting.

Figure 12:
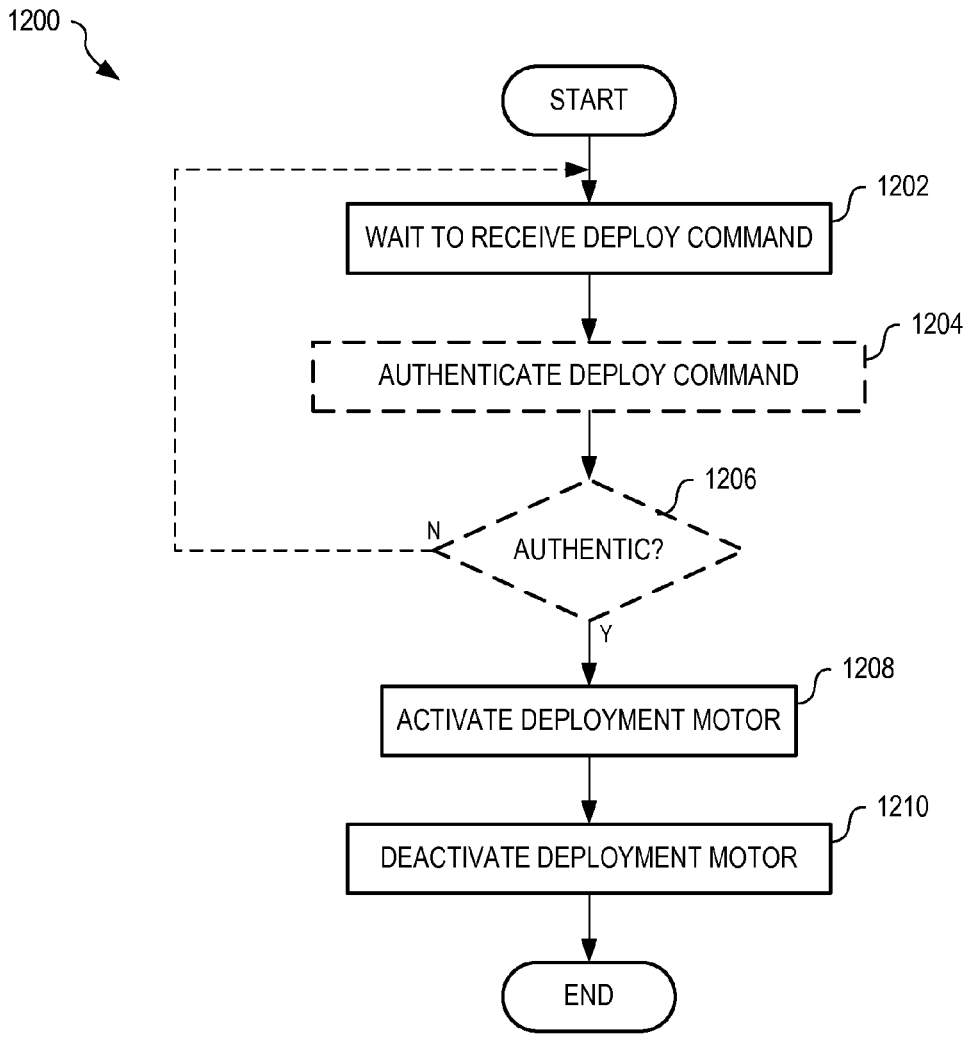
FIG. 12 is a flowchart illustrating one exemplary method for deploying the flood shield of FIG. 1 to protect the opening from ingress of water, in an embodiment.

FIG. 12 is a flowchart illustrating one exemplary method 1200 for deploying flood shield 100 of FIG. 1 to protect opening 153 from ingress of water. Method 1200 is for example implemented within software 1110 of controller 1100, FIG. 11, to deploy flexible shield 106 of flood shield 100.

In step 1202, method 1200 waits to receive a deploy command. In one example of step 1202, software 1110 monitors input from receiver/transceiver 1108 to wait for a deploy command to be received from any of remote 1180, mobile device 1190, and server 1150. Step 1204 is optional. If included, in step 1204, method 1200 authenticates the deploy command received in step 1202. In one example of step 1204, software 1110 identifies an authentication feature of deploy command 1109 as authentication of the source of deploy command 1109.

Step 1206 is an optional decision. If, in step 1206, method 1200 determines that the deploy command is authentic, method 1200 continues with step 1208; otherwise method 1200 continues with step 1202.

In step 1208, method 1200 activates the deployment motor. In one example of step 1208, software 1110 controls motor driver 1106 to drive motor 120, which winds cables 802 onto winding area 903 and pulls shield 106 from roller 702 until top 107 reaches top channel 108 after a predefined period.

In step 1210, method 1200 deactivates the deployment motor. In one example of step 1210, software 1110 controls motor driver 1106 to switch off power to motor 120 after the predefined period.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. A deployable flood shield for preventing ingress of water through an opening in a wall of a building, comprising:

an outer frame positioned to surround the opening and comprising a top channel, a bottom channel, a left channel and a right channel wherein the frame attaches to the wall and forms a water-tight seal between the frame and the wall;

a flexible shield stored within the top or bottom channel prior to deployment, the flexible shield having a left edge retained by the left channel and a right edge retained by the right channel;

seals configured with each of the bottom, left, and right channels for sealing between the bottom, left, and right channels and the flexible shield when deployed; and a controller for deploying the flexible shield to prevent the ingress of water into the opening.

2. The deployable flood shield of claim 1, wherein each of the left and right edges comprises a spring strip.

3. The deployable flood shield of claim 1, further comprising:

a rod laterally positioned within the top channel;

a left cable attached to (a) the left edge of the flexible shield and (b) the rod;

a right cable attached to (c) the right edge of the flexible shield and (d) the rod;

a motor for rotating the rod to simultaneously wind-up the left and right cables to deploy the flexible shield.

4. The deployable flood shield of claim 3, further comprising a ratchet mechanism mechanically coupled with the rod to prevent the left and right cables from unwinding.

5. The deployable flood shield of claim 3, further comprising gearing between the motor and the rod, wherein the gearing prevents the left and right cables from unwinding.

6. The deployable flood shield of claim 1, further comprising a roller laterally positioned within the bottom channel for storing the flexible shield, wherein a bottom edge of the flexible shield is permanently attached to the roller such that the bottom edge of the flexible shield is permanently retained within the bottom channel.

7. The deployable flood shield of claim 6, further comprising a release mechanism for allowing the flexible shield to be retracted.

8. The deployable flood shield of claim 7, further comprising a retracting mechanism for retracting the flexible shield into the bottom channel when released by the release mechanism.

9. The deployable flood shield of claim 8, the retracting mechanism comprising a spring that is wound up when the flexible shield is deployed.

10. The deployable flood shield of claim 1, further comprising a wireless receiver for receiving a deploy command within the controller from a radio transmitter, wherein the deploy command comprises an emergency broadcast signal from the radio transmitter.

11. The deployable flood shield of claim 1, further comprising at least one sensor coupled with the controller and positioned to detect environmental conditions proximate the deployable flood shield.

12. The deployable flood shield of claim 1, further comprising a transceiver for wirelessly communicating with a cellular network to receive a deploy command within the controller from a mobile device, the deploy command instructing the controller to automatically deploy the flexible shield to prevent the ingress of water into the opening.

13. The deployable flood shield of claim 12, further comprising one or more sensors coupled with the controller for sensing a status of the deployable flood shield.

14. The deployable flood shield of claim 13, the one or more sensors sensing a voltage of a battery configured with the deployable flood shield to provide power to the controller and a motor that is controlled by the controller to deploy the flexible shield.

15. The deployable flood shield of claim 13, the controller configured to send a current status of the deployable flood shield to a remote device via the wireless local area network.

16. The deployable flood shield of claim 1, further comprising a transceiver for wirelessly communicating with a wireless local area network to receive a deploy command within the controller, the deploy command instructing the controller to automatically deploy the flexible shield to prevent the ingress of water into the opening.

17. The deployable flood shield of claim 16, further comprising one or more sensors coupled with the controller for sensing a status of the deployable flood shield.

18. The deployable flood shield of claim 17, the one or more sensors sensing a voltage of a battery configured with the deployable flood shield to provide power to the controller and a motor that is controlled by the controller to deploy the flexible shield.

19. The deployable flood shield of claim 17, the controller configured to send a current status of the deployable flood shield to a remote device via the wireless local area network.

* * * * *